US005857128A

United States Patent [19]

Matsumoto

[11] Patent Number: 5,857,128

[45] Date of Patent: Jan. 5, 1999

[54] PHOTOSENSITIVE MATERIAL PROCESSING APPARATUS AND PHOTOSENSITIVE MATERIAL PROCESSING METHOD

[75] Inventor: Nobuo Matsumoto, Kanagawa, Japan

[73] Assignee: Fuji Photo Film Co., Ltd., Kanagawa, Japan

[21] Appl. No.: 808,540

[22] Filed: Feb. 28, 1997

[30] Foreign Application Priority Data

Feb. 29, 1996 [JP] Japan ..... 8-043622

[51] Int. Cl.[6] ..... G03D 3/08

[52] U.S. Cl. ..... 396/612; 396/615

[58] Field of Search ..... 396/591, 615, 396/620, 612; 355/27–29

[56] References Cited

U.S. PATENT DOCUMENTS 5,452,050 9/1995 Ishikawa et al. ..... 355/27

5,471,275 11/1995 Masuda ..... 396/599

*Primary Examiner*—D. Rutledge

*Attorney, Agent, or Firm*—Sughrue, Mion, Zinn, Macpeak & Seas, PLLC

[57] ABSTRACT

An object of the present invention is to provide a photosensitive material processing apparatus which is inexpensive, which automatically withdraws a photosensitive material from a cartridge, and which carries out efficient developing processing by carrying out developing processing of photosensitive materials in parallel. To achieve the above object, the photosensitive material processing apparatus which processes photosensitive materials which have been photographed includes: a photosensitive material withdrawing device for withdrawing a photosensitive material from a cartridge which accommodates the photosensitive material; a developing processing section having a plurality of photosensitive material conveying/processing lines which are disposed parallel to one another at a conveying direction downstream side of the photosensitive material withdrawing device; and a photosensitive material distributing device, provided between the photosensitive material withdrawing device and the developing processing section, for distributing a photosensitive material which has been withdrawn from a cartridge to any one of the plurality of photosensitive material conveying/processing lines.

21 Claims, 12 Drawing Sheets

PHOTOSENSITIVE MATERIAL PROCESSING APPARATUS AND PHOTOSENSITIVE MATERIAL PROCESSING METHOD

BACKGROUND OF THE INVENTION

1. Field of the Invention

The present invention relates to a photosensitive material processing apparatus and a photosensitive material processing method which withdraw photosensitive materials, such as films, from cartridges and process the withdrawn photosensitive materials.

2. Description of the Related Art

A film is loaded into a conventional film processor by adhering a leader film to the leading end of a film withdrawn from a cartridge in advance, and setting the leader film at a predetermined place.

The operation for removing the leading end of the film from the cartridge is complex, and mechanisms for automatically carrying out this operation have been proposed. However, these mechanisms are complicated and therefore expensive.

In an attempt to obtain a film processor which is both compact and exhibits good processing capabilities, usually two, or three, processing lines are provided in the film processor, and films pass through these plural processing lines. The processing capabilities can be improved even more by increasing the number of processing lines.

However, if mechanisms for automatically withdrawing the film leading ends are provided so as to correspond to the plural rows, the apparatus becomes extremely expensive. Therefore, mechanisms for automatically withdrawing film leading ends have not been able to be used at film processors equipped with a plurality of processing lines.

SUMMARY OF THE INVENTION

In view of the aforementioned, an object of the present invention is to provide a photosensitive material processing apparatus and photosensitive material processing method which are inexpensive, in which the leading ends of photosensitive materials can be automatically withdrawn from cartridges, and which can carry out developing processing of photosensitive materials in parallel.

The photosensitive material processing apparatus of the present invention processes photosensitive materials which have been photographed, and includes: photosensitive material withdrawing means for withdrawing a photosensitive material from a cartridge which accommodates the photosensitive material; a developing processing section having a plurality of photosensitive material conveying/processing lines which are disposed parallel to one another at a conveying direction downstream side of the photosensitive material withdrawing means; and photosensitive material distributing means, provided between the photosensitive material withdrawing means and the developing processing section, for distributing a photosensitive material which has been withdrawn from a cartridge to any one of the plurality of photosensitive material conveying/processing lines.

The photosensitive material processing apparatus of the present invention as set forth above has the following effects.

The photosensitive material accommodated in the cartridge is automatically withdrawn from the cartridge by the photosensitive material withdrawing means. The withdrawn photosensitive material is, by the photosensitive material distributing means, distributed to any line of the plurality of photosensitive material conveying/processing lines, and developing processing is carried out. Because a plurality of photosensitive material conveying/processing lines are provided in the developing processing section, a plurality of photosensitive materials can be processed in parallel, and efficient processing of plural photosensitive materials is possible. Further, the photosensitive material withdrawing means which withdraws the photosensitive material from the cartridge is formed by a plurality of devices, for example, a device for rotating the spool shaft around which the photosensitive material is wound, a device for opening the photosensitive material entrance/exit of the cartridge, a device for separating from the spool shaft the photosensitive material which is engaged therewith, and the like. Therefore, the mechanisms of the photosensitive material withdrawing means tend to be complex. Accordingly, if a plurality of photosensitive material withdrawing means are provided in correspondence with the plurality of photosensitive material conveying/processing lines, a drawback arises in that the number of parts of the apparatus increases in accordance with the number of lines. However, if the photosensitive material distributing means of the present invention is used, it suffices to provide a single photosensitive material distributing means for the photosensitive material processing apparatus. Even if the number of photosensitive material conveying/processing lines increases, only the distance over which the photosensitive materials move when being distributed increases, and the number of parts does not increase. Accordingly, an increase in the cost of the apparatus due to an increase in the number of photosensitive material conveying/processing lines can be suppressed. Further, the greater the number of lines, the greater the advantage of the present invention.

In the photosensitive material processing apparatus of the present invention, the photosensitive material distributing means includes a storing portion for temporarily storing a photosensitive material, which has been conveyed in from the photosensitive material withdrawing means, before the photosensitive material is delivered out to said developing processing section.

The effects of the photosensitive material processing apparatus of having the above feature are as follows.

The distributing means is provided with a storing portion for temporarily storing photosensitive materials. A photosensitive material withdrawn from a cartridge is made to standby temporarily before being conveyed into the developing processing section. In this way, for example, if the trailing end of the preceding photosensitive material has not completely entered into the developing processing section or the like, the subsequent photosensitive materials can be made to wait in order in the storing portion.

In the photosensitive material processing apparatuses of the present invention, the storing portion is an attracting/holding means which can attract and hold the photosensitive material.

The photosensitive material processing apparatuses having such a feature and have the following effects.

The photosensitive material which has been withdrawn from the cartridge is attracted to and held by the attracting/holding means. If the holding of the photosensitive material by attraction is released, the photosensitive material can freely move back and forth. Further, because the photosensitive material is held by attraction, no local forces are applied to the photosensitive material as compared with a case in which, for example, the photosensitive material is held for conveying and stopped by nip rollers or the like. Examples of the method of attraction include attraction (suction) by negative pressure (a vacuum), attraction by static electricity, and the like.

In the present invention of the photosensitive material processing apparatus, the storing portion is provided with a conveying direction changing means which changes the conveying direction of the photosensitive material. Such an apparatus has the following effects.

In the photosensitive material processing apparatus, the conveying direction of the photosensitive material withdrawn from the cartridge can be changed by the conveying direction changing means. Therefore, the photosensitive material can be conveyed to the developing processing section with the trailing end at the time the photosensitive material is withdrawn from the cartridge (i.e., the end at the spool shaft side) being the conveying direction leading end.

In the present invention of the photosensitive material processing apparatus, a photosensitive material inspecting means which inspects photosensitive materials is provided between the photosensitive material withdrawing means and the developing processing section. Such an arrangement has the following effects.

In the photosensitive material processing apparatus of the present invention, before the photosensitive material is processed in the developing processing section, the photosensitive material withdrawn from the cartridge is inspected for damage or for connections or the like. In this way, trouble in conveying (e.g., the photosensitive material getting caught on parts within the apparatus or, as a worst case scenario, the photosensitive material being torn in pieces, or the like) which is caused by damage to the photosensitive material can be prevented in advance. Further, when the photosensitive material is damaged or when the photosensitive material is connected by tape or the like, a warning may be given so that the operator or the like may know that there is the possibility that conveying troubles may occur.

In the present invention of the photosensitive material processing apparatus, a reshaping means, which reshapes the conveying direction end portion of the photosensitive material, is provided between the photosensitive material withdrawing means and the developing processing section and has the following effects.

The conveying direction end portion of the photosensitive material withdrawn from the cartridge is reshaped to a predetermined configuration by the reshaping means. For example, the conveying direction leading end portion of the photosensitive material is formed in a configuration which allows for easy passage through the interior of the developing processing section (e.g., a U-shaped configuration). In this way, the photosensitive material can be conveyed smoothly within the developing processing section, and the reliability of conveying can be improved.

Also disclosed are photosensitive material processing methods differing in accordance with the respective embodiments and features of the present invention.

DESCRIPTION OF THE PREFERRED EMBODIMENTS

First Embodiment

A first embodiment of the present invention will be described hereinafter in accordance with FIGS. 1 through 8.

Figure 1:
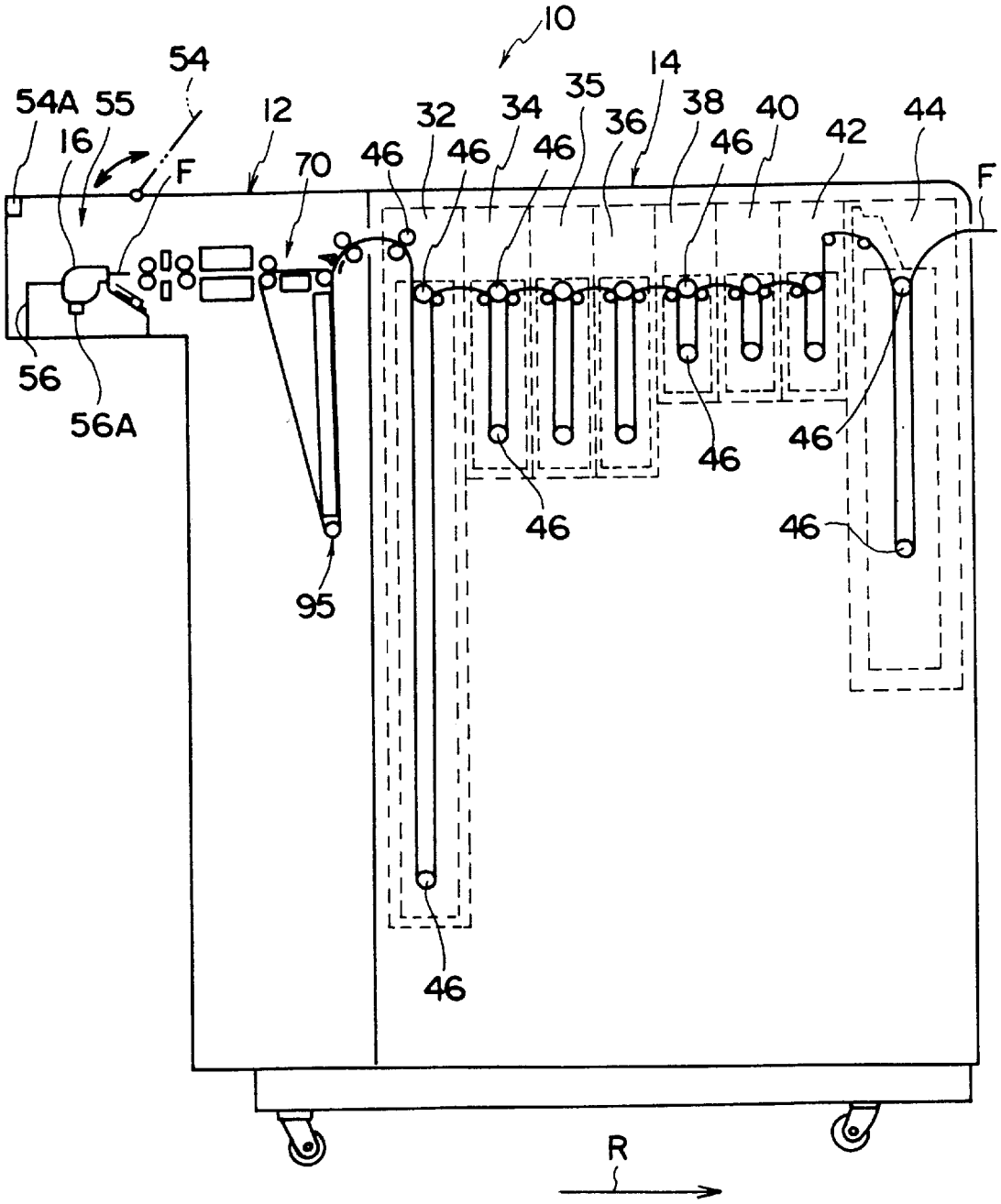
FIG. 1 is a side view illustrating the internal structure of a printer processor relating to a first embodiment.

A film processor 10, which serves as a photosensitive material processing apparatus, is illustrated summarily in FIG. 1. The film processor 10 is equipped with a film loading/distributing section 12 and a developing processing section 14. Cartridges 16 housing films F which have been photographed are loaded into the film loading/distributing section 12, and the films F of the loaded cartridges 16 are conveyed to the developing processing section 14. The developing processing section 14 carries out developing processing of the films conveyed from the film loading/distributing section 12.

(Cartridges)

The cartridge 16 will be summarily described hereinafter with reference to FIG. 2.

The cartridge 16 is provided with a substantially cylindrical casing 18. A pass-through opening 20 through which the film F passes is closed by a door 22 so that the interior of the cartridge 16 is shaded from light.

A door shaft 24 is provided integrally with the both ends of the door 22, and is rotatably supported at the casing 18. At the cartridge 16, by rotating the door shaft 24, the door 22 rotates so as to open and close the pass-through opening 20. A key hole 24A is formed at an end portion of the door shaft 24. A door driver 26 for rotating the door shaft 24 engages the key hole 24A.

A spool shaft 28 around which the film F is wound is rotatably supported at the casing 18. A key hole 28A is provided at each end of the spool shaft 28. A spool driver 30 for rotating the spool shaft 28 engages one of the key holes 28A.

Figure 3:
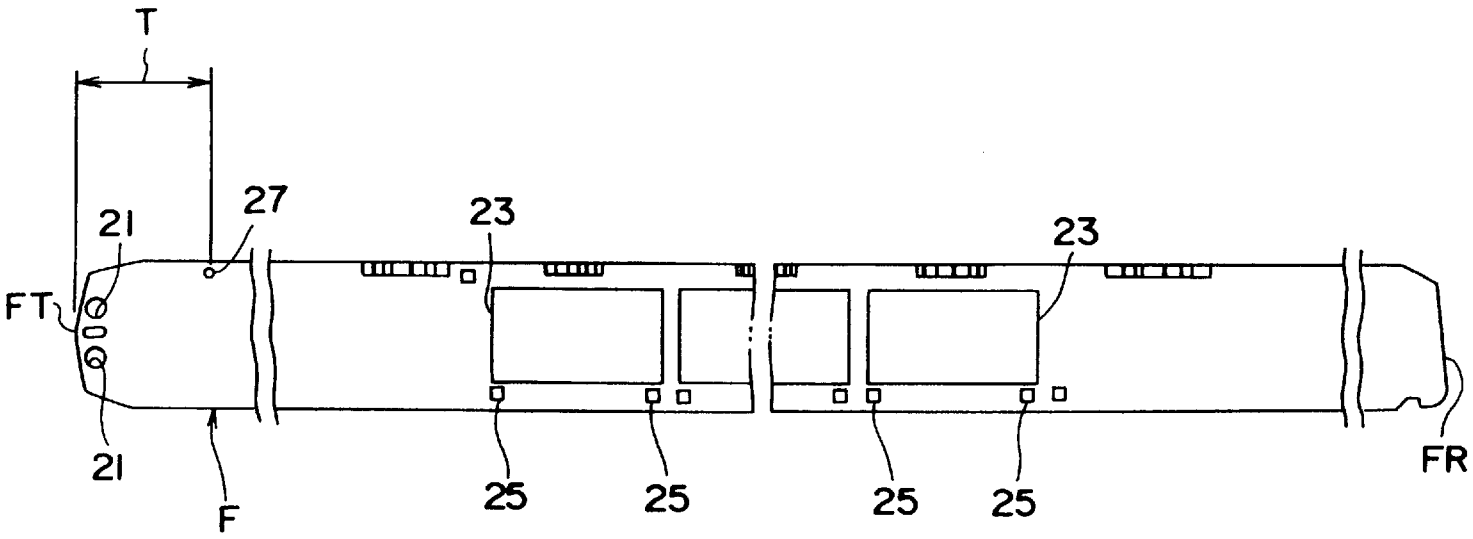
FIG. 3 is a plan view of a film.

As illustrated in FIG. 3, a pair of engagement holes 21 are formed in the trailer side end portion FT of the film F (i.e., the end portion of the film F at the side which is anchored to the spool shaft 28). The engagement holes 21 engage projecting portions provided at unillustrated slit holes at an intermediate portion of the spool shaft 28 (which is not illustrated in FIG. 3). In this way, the engagement holes 21 serve to anchor the film F to the spool shaft 28. The film F is taken up on the spool shaft 28 and accommodated within the cartridge 16 with the trailer side end portion FT of the film F anchored to the spool shaft 28.

Perforations 25 which show the positions of image frames 23 are formed in one transverse direction end portion of the film F at predetermined intervals. A detach perforation 27 is formed in the film F at a position which is separated from the trailer side end portion FT by a fixed interval T. When the detach perforation 27 is detected, the position of the trailer side end portion FT of the film F can be accurately determined.

(Developing Processing Section)

As illustrated in FIG. 1, a color developing tank 32, a bleaching tank 34, a bleaching-fixing tank 35, a fixing tank 36, super-rinse tanks 38, 40, a stabilizing tank 42, and a drying section 44 are provided in that order in the developing processing section 14. A plurality of conveying rollers 46 are provided in each of the tanks and in the drying section 44. The conveying rollers 46 convey the film F such that the film F is successively subjected to color developing processing, bleaching processing, bleaching-fixing processing, fixing processing, rinsing processing, stabilizing processing, and drying processing.

The conveying rollers 46 are driven and rotated by an unillustrated motor.

Figure 4:
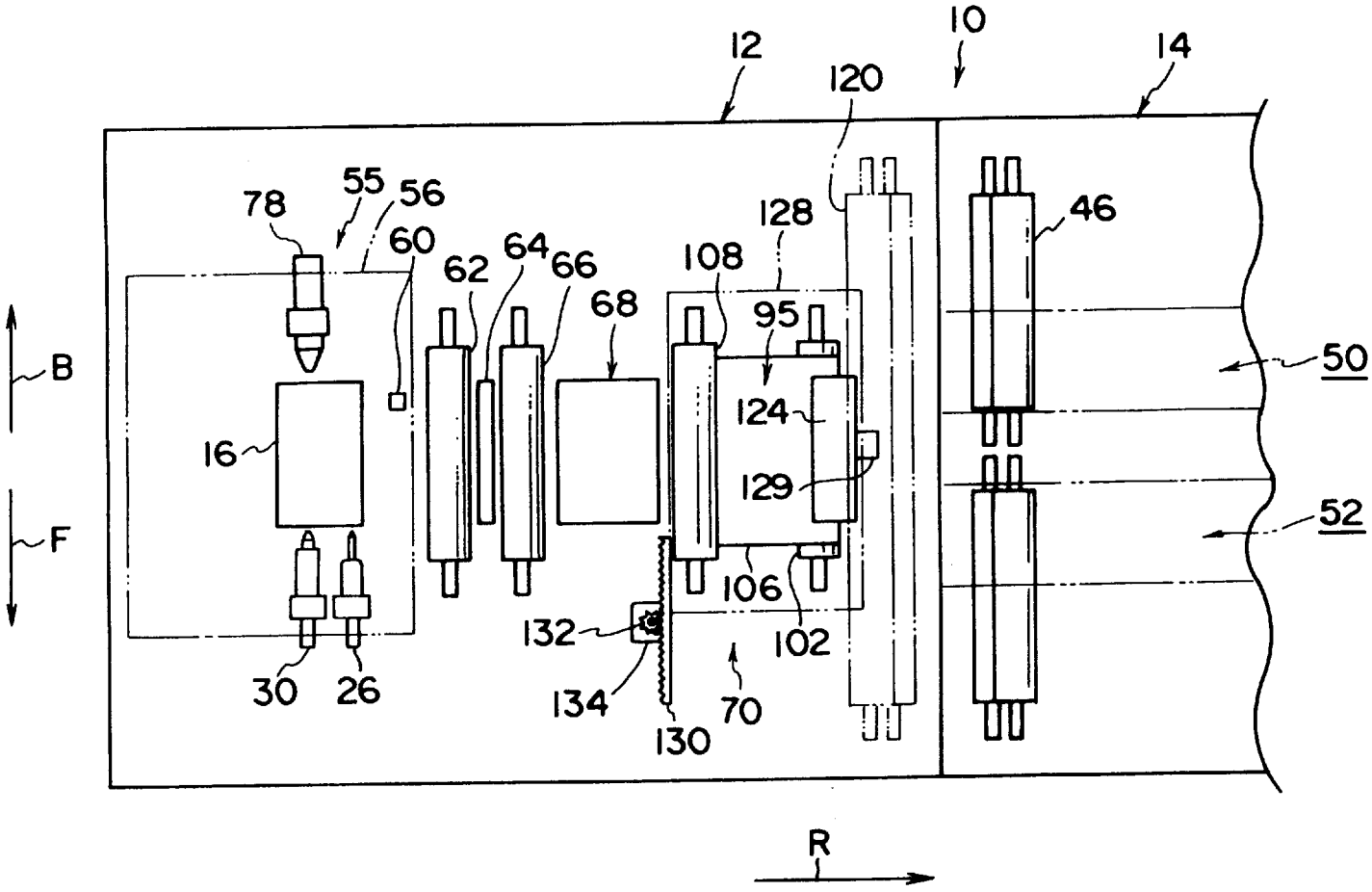
FIG. 4 is a plan view of a film loading/distributing section.

As illustrated in FIG. 4, in the developing processing section 14 of the present embodiment, two conveying/processing lines, a first conveying/processing line 50 and a second conveying/processing line 52 are provided in parallel so that developing processing of a plurality of films F can be carried out in parallel.

In the developing processing section 14, so-called leaderless conveying is carried out in which the transverse direction ends of the film F are inserted into guide grooves (not illustrated) and the film F is conveyed while being guided by the guide grooves.

(Film Loading/Distributing Section)

As illustrated in FIG. 1, a cover 54 is provided at the film loading/distributing section 12. The cover 54 can be opened and can be closed so as to shield the interior of the film loading/distributing section 12 from light. A photosensitive material withdrawing means 55 is provided within the film loading/distributing section 12. As shown in FIG. 2, a nest 56 in which the cartridge 16 is loaded is provided at the photosensitive material withdrawing means 55. As shown in FIG. 1, a sensor 54A for detecting the open or shut state of the cover 54 is mounted at the film loading/distributing section 12. A sensor 56A which detects the existence of a cartridge 16 within the nest 56 is mounted at the nest 56.

Figure 5A:
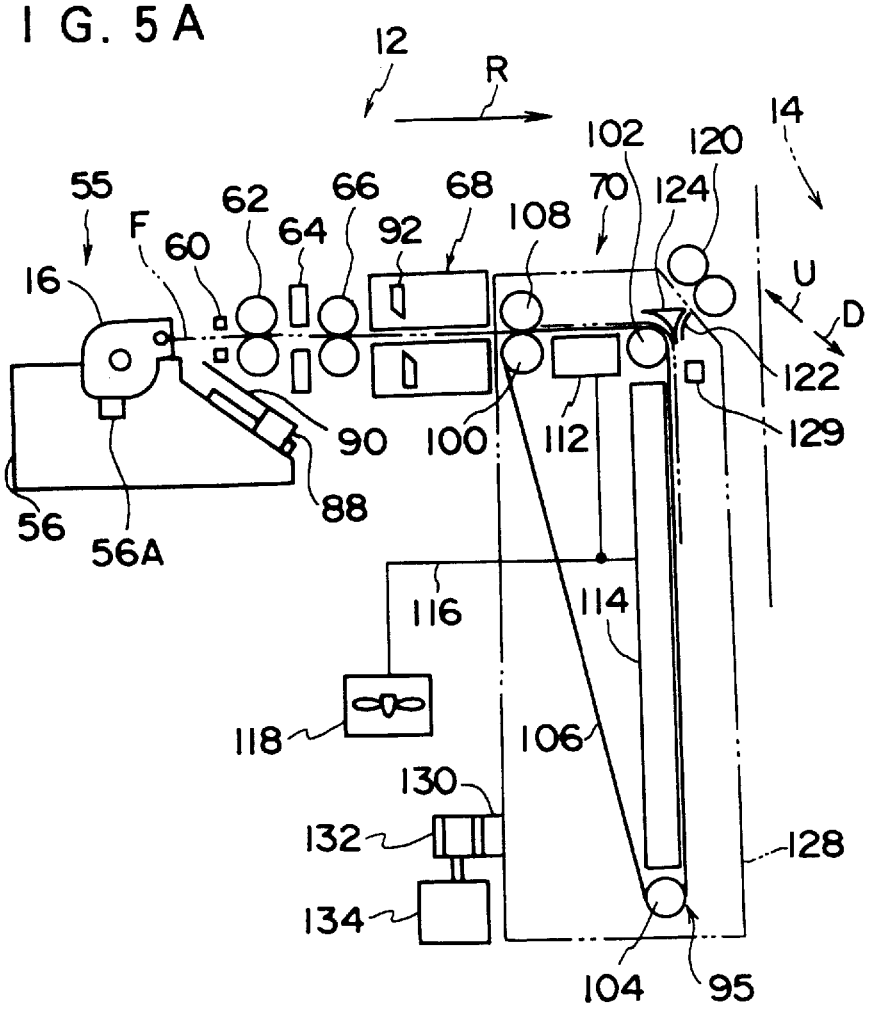
FIG. 5A is a side view of the film loading/distributing section.

As shown in FIG. 5A, a transmission-type infrared ray sensor 60, nip rollers 62, a film inspecting device 64 serving as a photosensitive material inspecting means, nip rollers 66, and a film end reshaping device 68 serving as a reshaping means are disposed in that order along the horizontal direction at the developing processing section side of the nest 56 (the side of the nest 56 in the direction of arrow R). A film distributing device 70 serving as a photosensitive material distributing means is provided between the film end reshaping device 68 and the developing processing section 14.

Figure 2:
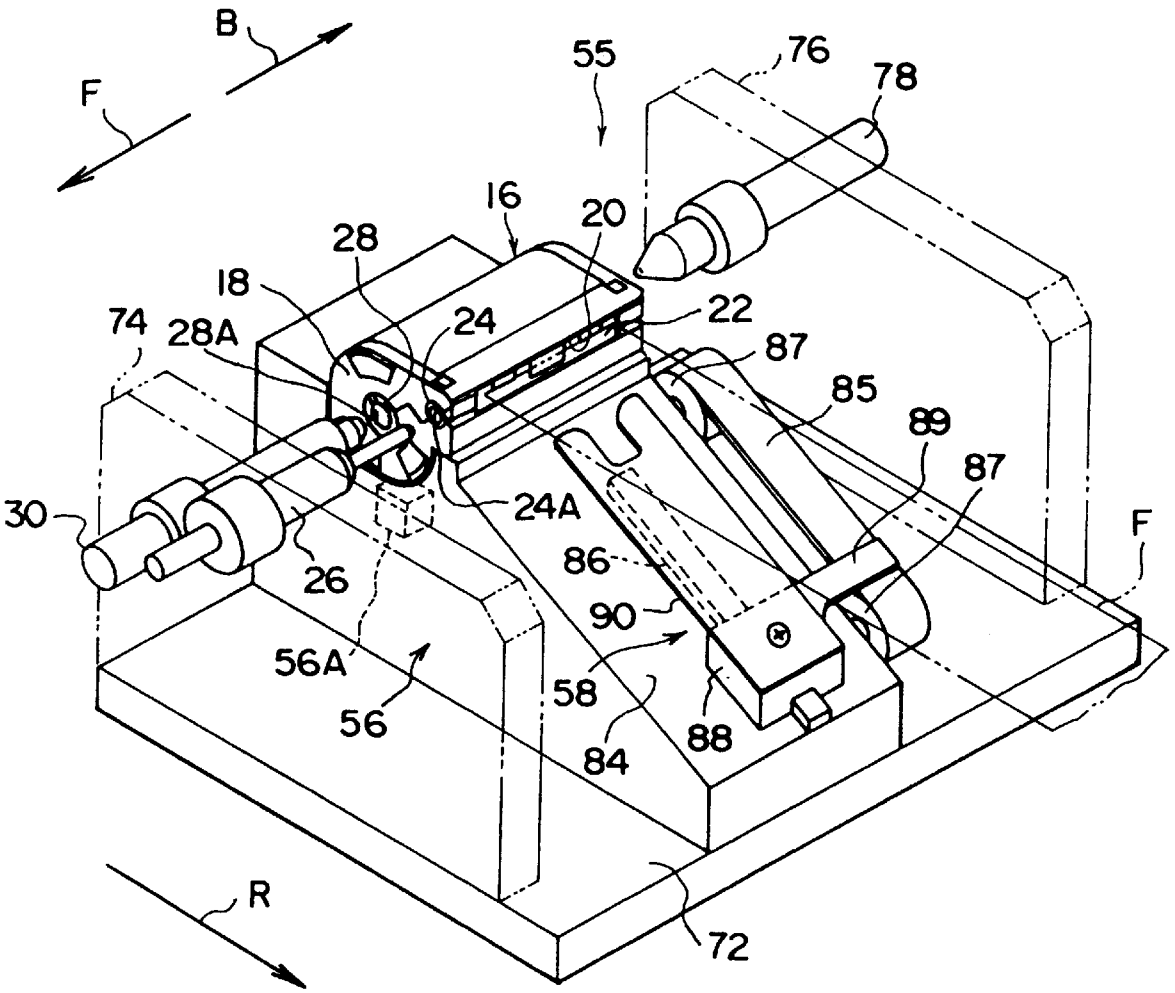
FIG. 2 is a perspective view of the periphery of a nest

As shown in FIG. 2, the nest 56 is mounted on a base plate 72. A side plate 74 is provided upright at the base plate 72 at the end portion in the direction of arrow F, and a side plate 76 is provided upright at the base plate 72 at the end portion in the direction of arrow B.

A slide driver 78 is provided at the side plate 76. The slide driver 78 is coaxial with the spool shaft 28 of the cartridge 16 loaded in the nest 56, and is movable along the axial direction. The spool driver 30 and the door driver 26 are provided at the other side plate 74. The spool driver 30 is rotatable and is coaxial with the spool shaft 28. The door driver 26 is rotatable and is coaxial with the door shaft 24.

The slide driver 78 is projected by an unillustrated slide solenoid, engages the spool shaft 28, and pushes the cartridge 16 toward the side plate 74. The spool driver 30 and the door driver 26 thereby engage the key hole 28A of the spool shaft 28 and the key hole 24A of the door shaft 24, respectively. In this state, when the door driver 26 is rotated by an unillustrated motor, the door 22 of the cartridge 16 opens so that the pass-through opening 20 is opened. By driving and rotating the spool driver 30 by an unillustrated motor, the spool shaft 28 rotates, and the film F is pushed out from the pass-through opening 20.

An inclined surface 84, which inclines downward at a predetermined angle, is formed at the side of the nest 56 at which the pass-through opening 20 of the cartridge 16 is disposed. A linear guide rail 86 is disposed on the inclined surface. A detach plate 90 is mounted to a slide block 88 which slidably engages with the guide rail 86.

A pair of pulleys 87, about which an endless belt 85 is entrained, is disposed at the side of the nest 56. A connecting member 89 which extends from the slide block 88 is attached to the endless belt 85. When the pulleys 87 are rotated by an unillustrated motor and the endless belt 85 is rotated in a predetermined direction, the slide block 88 moves on the inclined surface 84 along the guide rail 86. When the slide block 88 moves at an upward incline, the distal end of the detach plate 90 moves toward the pass-through opening 20 of the cartridge 16.

As illustrated in FIG. 5A, the infrared ray sensor 60 is positioned in a vicinity of the cartridge 16 loaded in the nest 56, and can detect the leading and trailing ends and the detach perforation 27 of the film F.

The nip rollers 62, 66 nip the film F which is delivered out from the cartridge 16, and convey the film F to the film distributing device 70.

By using infrared rays which do not photosensitive the film F, the film inspecting device 64 inspects whether the film F is damaged, e.g., is torn or the like (or inspects whether the film F is connected by tape or the like). In the present embodiment, infrared rays are illuminated onto the film F, the amount of transmitted infrared rays is measured by infrared ray sensors disposed in a row along the film transverse direction at the opposite side of the film F, and the existence of tears (or the existence of a connection) is detected by changes in the amount of transmitted infrared rays. Film inspection can be carried out by photographing the film F with an infrared ray camera and carrying out image processing with a computer, or by an operator visually inspecting the film F (the infrared ray transmitted image) displayed on a monitor.

The film end reshaping device 68 is provided with a cutter 92 which shapes the conveying direction leading end portion of the film F into, for example, a U-shape so that the leading end portion can easily pass through the interior of the developing processing section 14.

The film distributing device 70 is equipped with an attracting conveyor 95 (corresponding to the storing portion, the attracting/holding means, and the conveying direction changing means of the present invention). The attracting conveyor 95 has an entraining roller 100, an entraining roller 102, and an entraining roller 104 which are disposed at predetermined intervals. An endless belt 106 is entrained about the entraining rollers 100, 102, 104, so as to form a substantially triangular locus of movement.

A roller 108 is provided above the entraining roller 100 such that the endless belt 106 is nipped between the roller 108 and the entraining roller 100. The entraining roller 100 is rotated by an unillustrated motor. The endless belt 106 can thereby be rotated clockwise and counterclockwise in FIG. 5A.

A suction box 112 is provided between the entraining roller 100 and the entraining roller 102, and a suction box 114 is provided between the entraining roller 102 and the entraining roller 104. The portions of the suction boxes 112,114 which oppose the endless belt 106 are planar and contact the reverse surface of the endless belt 106.

A large number of small holes (unillustrated) are formed in the entire endless belt 106. A large number of small holes (unillustrated) are formed, so as to correspond to the small holes of the endless belt 106, in the planar portions of the suction box 112 and the suction box 114 which contact the reverse surface of the endless belt 106. The respective interiors of the suction boxes 112, 114 are hollow, and the air therein is sucked by a suction device 118 via a duct 116.

Accordingly, when the air within the suction boxes 112, 114 is sucked by the suction device 118, air is sucked from the small holes of the endless belt 106 contacting the suction boxes 112, 114. The film F can thereby be sucked (attracted) to the endless belt 106.

Nip rollers 120, which send the film F into the developing processing section 14, are provided above the entraining roller 102 at a diagonal toward the developing processing section 14.

A fixed guide 122 and a movable guide 124 are provided between the entraining roller 102 and the nip rollers 120.

Figure 5B:
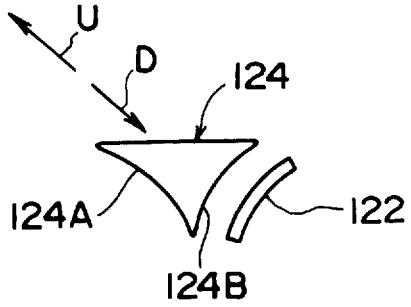
FIG. 5B is a side view of a movable guide and a fixed guide.

As illustrated in FIG. 5B, a first curved surface 124A and a second curved surface 124B are formed at the movable guide 124. The movable guide 124 can be moved by an unillustrated driving device in the direction of arrow U and in the direction of arrow D in FIGS. 5A and 5B. The first curved surface 124A guides the film F, which has been delivered out from the cartridge 16, toward the linear conveying portion of the endless belt 106 opposing the suction box 114. The second curved surface 124B guides the film F, which is attracted to the linear conveying portion of the endless belt 106, toward the nip rollers 120 with the film F between the second curved surface 124B and the fixed guide 122.

As illustrated in FIG. 5A, an infrared ray sensor 129 which detects the film F is provided in a vicinity of the entraining roller 102 at a position which opposes the vertically-disposed linear conveying portion of the endless belt 106.

In the film distributing device 70, the entraining rollers 100, 102, 104, the roller 108, the suction boxes 112, 114, the fixed guide 122, the movable guide 124 and the infrared ray sensor 129 are mounted integrally to a frame 128 so as to form a unit.

The film distributing device 70 is guided by unillustrated slide rails so as to be able to slide in directions orthogonal to the plane of the paper of FIG. 5A(in the direction of arrow F and in the direction of arrow B in FIG. 4). Further, as shown in FIGS. 4 and 5A, a rack 130 extending along the transverse direction of the film F is mounted to the film distributing device 70. The film distributing device 70 is moved by a pinion gear 132, which meshes with the rack 130, being rotated by a motor 134.

The driving devices, such as motors, solenoids, and the like, and the various sensors are connected to a control device (not shown), and the driving devices, such as motors, solenoids and the like, are controlled by the control device.

So that the film F therewithin is not photosensitized, the film loading/distributing section 12 is provided with a lock means (not shown) so that the cover 54 cannot be opened until the trailing end of the film F is conveyed to a predetermined position at which the film F cannot be photosensitized.

Next, operation of the present first embodiment will be described with reference to the flowcharts of FIGS. 6 and 7.

Figure 6:
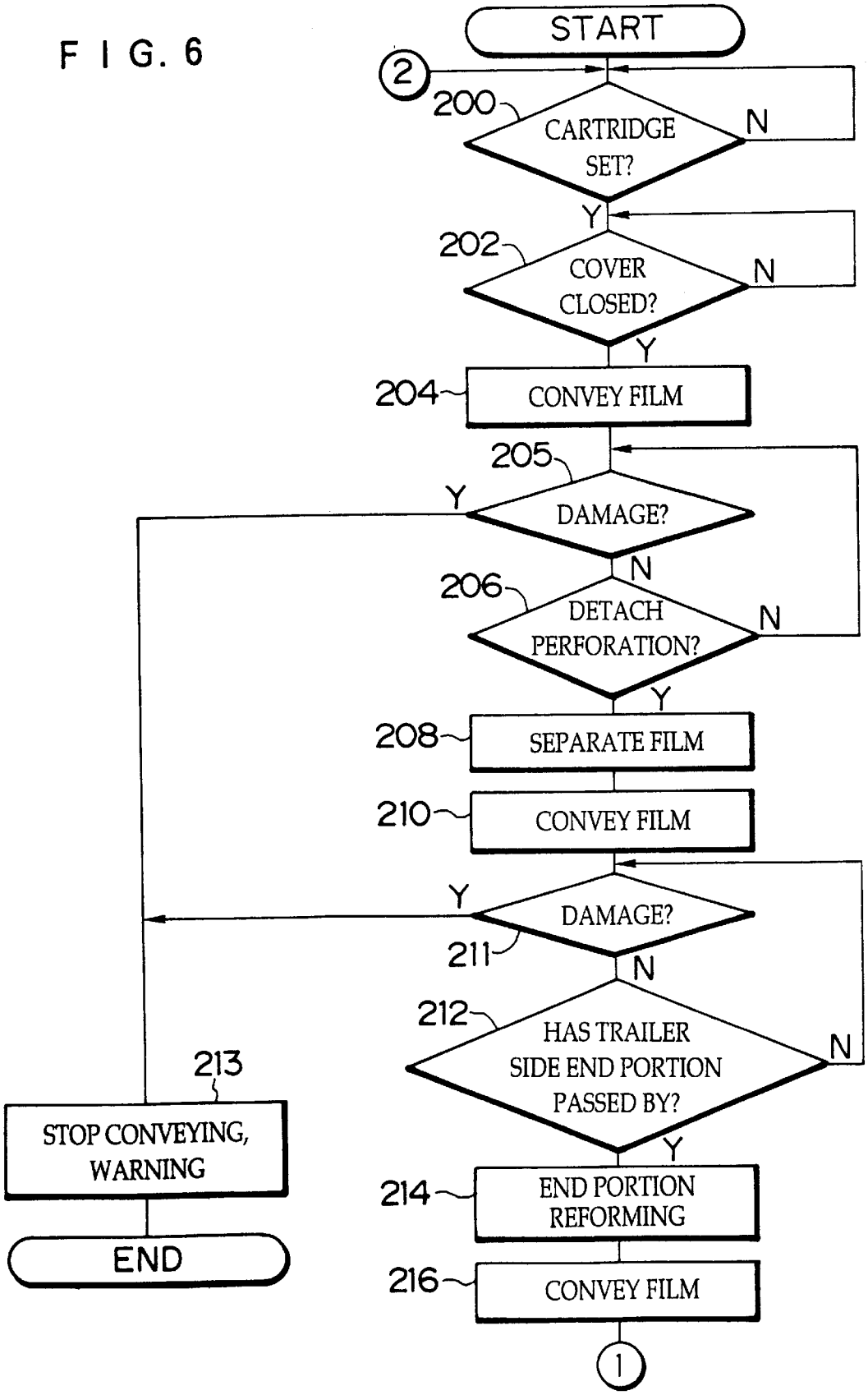
FIG. 6 is a flowchart explaining control.

First, as illustrated in FIG. 6, in step 200, a judgment is made as to whether the cartridge 16 has been set in the nest 56. If it is judged in step 200 that the cartridge 16 has been set, the routine proceeds to step 202, where a judgment is made as to whether the cover 54 is closed.

If it is judged in step 202 that the cover 54 is closed, the routine proceeds to step 204 where the door driver 26 is rotated, the door 22 of the cartridge 16 is opened, the spool driver 30 is rotated, the film F is pushed out from the pass-through opening 20, the nip rollers 62, 66 are rotated, and the film F is delivered out from the cartridge 16. From the standpoint of processing efficiency, it is preferable that the film conveying speed at this time is, to a certain extent, a high speed.

When the film F begins to be delivered out, the routine proceeds to step 205 where damage to the film F is detected by the film inspecting device 64. If it is judged that there is damage, the routine proceeds to step 213 where conveying of the film F is stopped, and the operator is warned such as by a buzzer being sounded or the like. When there is damage to the film F such as tears or the like, problems may arise while the film F is being conveyed along the conveying path, such as the film F may catch on a part within the apparatus or may be ripped in two or more pieces or the like. By detecting the existence of damage in advance, such problems can be obviated. After the conveying of the film F is stopped, the film F may be slowly rewound onto the cartridge 16.

If no damage is detected, the routine proceeds to step 206, where a judgment is made as to whether the detach perforation 27 has been detected. When the detach perforation 27 is detected, the routine proceeds to step 208 where the delivering out of the film F is stopped, the distal end of the detach plate 90 is inserted into the pass-through opening 20 of the cartridge 16, and the film F is separated from the spool shaft 28.

When the film F is separated from the spool shaft 28, the routine proceeds to step 210 where conveying of the film F is carried out.

When conveying of the film F begins, the routine proceeds to step 211 where the film F is inspected for damage by the film inspecting device 64. If it is judged that the film F is damaged, the routine proceeds to step 213 where conveying of the film F is stopped, and the operator is warned by a buzzer being sounded or the like.

If no damage is detected, the routine proceeds to step 212. In step 212, a judgment is made as to whether the trailer side end portion FT of the film F has passed by the infrared ray sensor 60.

In step 212, when it is judged that the end portion FT has passed by, the routine proceeds to step 214. In step 214, after the film F is conveyed a predetermined amount, the film F is stopped, and the end of the film F which will be the conveying direction leading end of the film F in the developing processing section 14, i.e., the trailer side end portion FT in the present embodiment, is reshaped in a predetermined shape (e.g., a U-shape) by the film end reshaping device 68 so that the trailer side end portion FT can easily pass through the developing processing section 14.

After the trailer side end portion FT is reshaped, the routine proceeds to step 216 where conveying of the film F is carried out. The film F is attracted to the endless belt 106, and is conveyed toward the side at which the suction box 114 is disposed.

Figure 7:
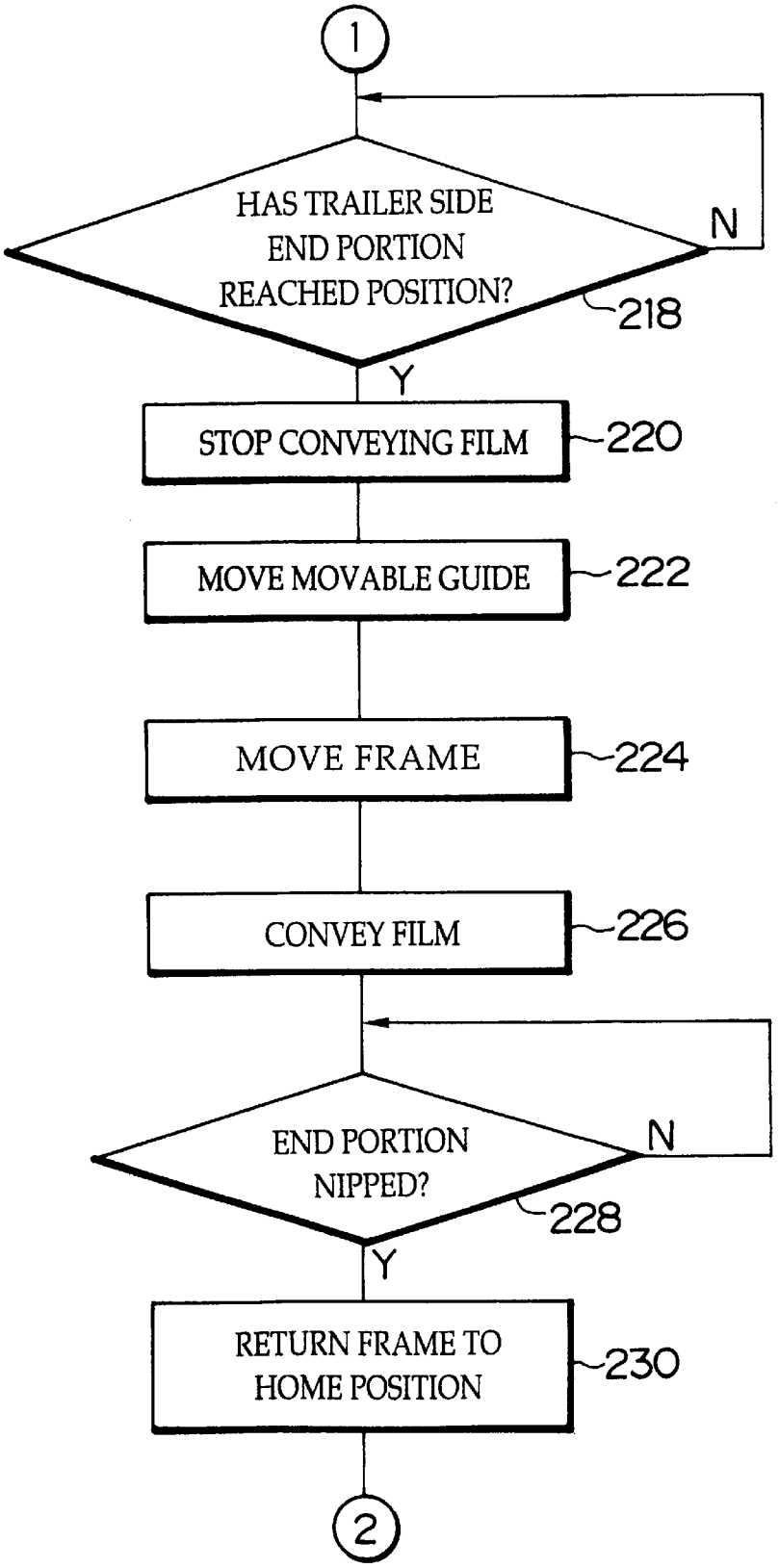
FIG. 7 is a continuation of the flowchart of FIG. 6.

As shown in FIG. 7, in subsequent step 218, a judgment is made as to whether the trailer side end portion FT of the film F (the conveying direction trailing end) has reached a position opposing the infrared ray sensor 129.

When it is determined that the trailer side end portion FT of the film F has reached the position opposing the infrared ray sensor 129, the routine proceeds to step 220 where driving of the endless belt 106 is stopped, and conveying of the film F is stopped.

Figure 8:
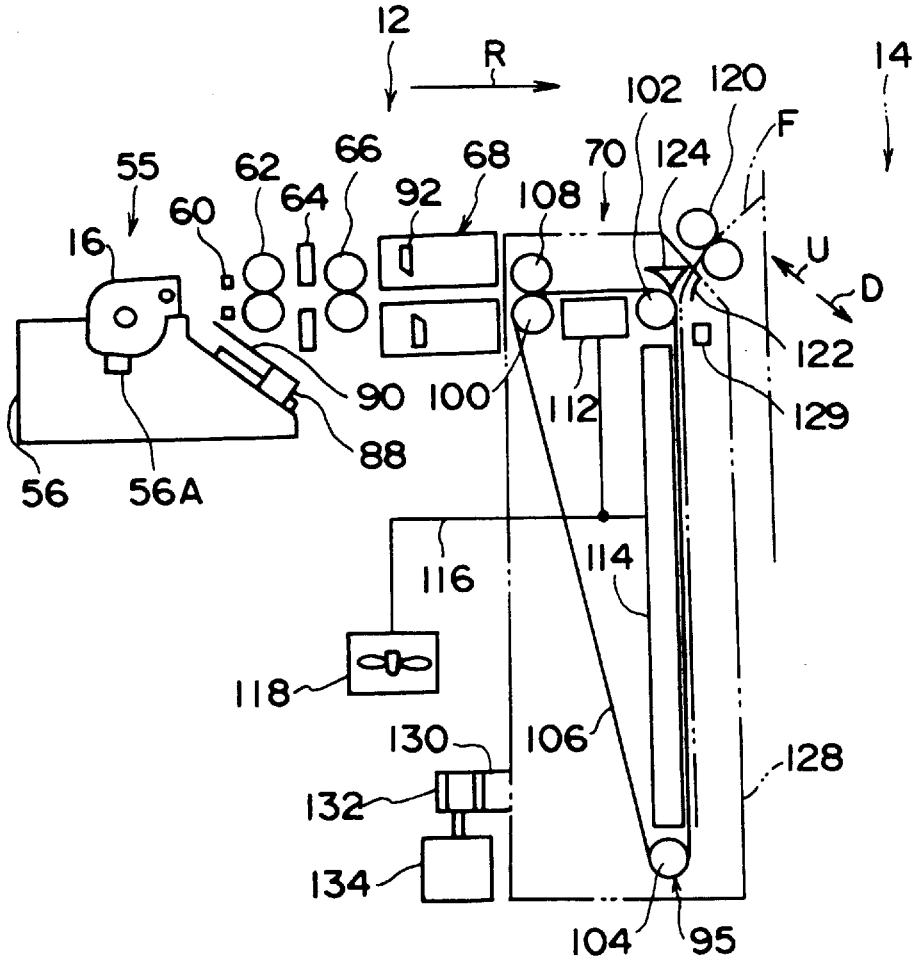
FIG. 8 is a side view of the film loading/distributing section, illustrating a state in which a film is conveyed to a developing processing section.

In step 222, the movable guide 124 is moved in the direction of arrow U so as to move from the state illustrated in FIG. 5A to the state illustrated in FIG. 8.

In step 224, the film distributing device 70 is moved from its home position (a position between the first conveying/processing line 50 and the second conveying/processing line 52) to the entrance of the first conveying/processing line 50.

In step 226, the endless belt 106 is rotated counterclockwise, and the film F is conveyed. In this way, the film F is conveyed, between the fixed guide 122 and the movable guide 124 and via the nip rollers 120, into the developing processing section 14 with the trailer side end portion FT of the film F being the conveying direction leading end. The film F undergoes developing processing in the developing processing section 14. In light of developing processing, the film conveying speed within the developing processing section 14 is a low speed. Therefore, when the film F is conveyed toward the developing processing section 14, the film conveying speed of the endless belt 106 is a low speed corresponding to the film conveying speed of the developing processing section 14. At other times, the film F is conveyed at a high speed in order to improve the processing efficiency.

The conveying direction leading end of the film F which is delivered into the developing processing section 14 has been reshaped by the film end reshaping device 68. Therefore, the film F can be conveyed smoothly within the developing processing section 14, and trouble in conveying, such as the leading end catching on parts or the like can be prevented. As a result, the reliability of conveying improves.

If the conveying direction leading end of the film F is nipped by the first conveying rollers 46 of the developing processing section 14, the remainder of the film F is automatically pulled into the interior of the developing processing section 14. Therefore, there is no need for attraction of the film F. As a result, in the present first embodiment, when the conveying direction leading end of the film F is nipped by the first conveying rollers 46 of the developing processing section 14, attraction (suction) of the film F is stopped. When the attraction is stopped, the film F can separate from the endless belt 106. Therefore, when the conveying direction leading end of the film F is nipped by the first conveying rollers 46 of the developing processing section 14, the film distributing device 70 can immediately be returned to its home position. In this way, the interval between a preceding film F and the film F that is processed thereafter can be shortened, so that processing efficiency can be improved.

Accordingly, in step 228, a judgment is made as to whether the trailer side end portion FT of the film F has been nipped by the first conveying rollers 46 of the developing processing section 14. (In the present embodiment, a judgment is made as to whether a predetermined period of time has elapsed from the time when conveying of the film F starts.) If it is determined that the film F has been nipped, the routine proceeds to step 230 where the film distributing device 70 is returned to its home position, and the movable guide 124 is returned in the direction of arrow D (i.e., returned to the position illustrated in FIG. 5A). Thereafter, the routine returns to step 200, and the processes are repeated.

The films F are distributed by the film distributing device 70 (step 224) alternately to the first conveying/processing line 50 and the second conveying/processing line 52.

In this way, the film processor 10 of the present first embodiment, because films F can be subject to developing processing in parallel in a plurality of lines, is efficient.

Although developing processing of the films F is carried out in plural lines, there is one place at which the cartridges 16 are loaded, and it suffices to use one automatic supplying mechanism for withdrawing and separating the film F from the cartridge 16. Therefore, even if the number of developing processing lines is increased, the number of parts only increases to the extent that the moving distance of the film distributing device 70 is extended, and an inexpensive, efficient device can be obtained.

Further, the film distributing device 70 is provided with an attracting/conveying mechanism which both conveys and buffers the film F. Therefore, the device can be made small, and due to the buffering function, the inspection of the film for damage, reshaping of the end of the film or the like can be efficiently performed without loss of time.

Second Embodiment

The film processor 10 relating to a second embodiment of the present invention will be described hereinafter with reference to FIGS. 9 and 10. Structures which are the same as those of the first embodiment are denoted by the same reference numerals, and description thereof is omitted.

Figure 9:
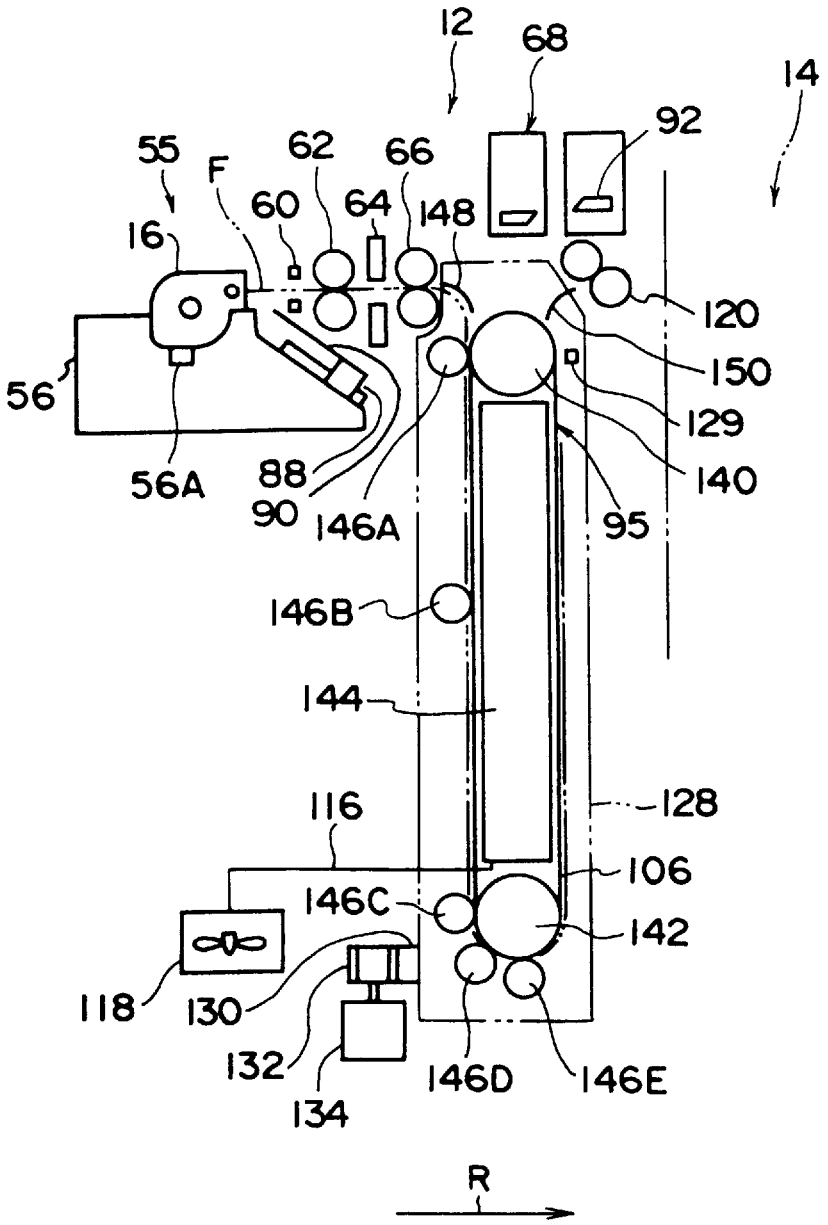
FIG. 9 is a side view of a film loading/distributing section relating to a second embodiment.

As illustrated in FIG. 9, entraining rollers 140, 142, which are separated from one another in the vertical direction, are provided between the nip rollers 66 and the nip rollers 120. The endless belt 106 is entrained around the entraining rollers 140, 142. A suction box 144 is disposed between the entraining roller 140 and the entraining roller 142. The suction box 144 can suck air from both surfaces thereof which oppose the linear portions of the endless belt 106.

Rollers 146A through 146E are disposed at the outer peripheral side of the endless belt 106 along the endless belt 106.

A fixed guide 148 is provided at the film conveying direction downstream side of the nip rollers 66. The fixed guide 148 guides, between the roller 146A and the endless belt 106, the film F which has been delivered out from the nip rollers 66. In this way, the film F which has been delivered out from the nip rollers 66 passes by the fixed guide 148 and between the roller 146A and the endless belt 106, and thereafter, is conveyed downward while being attracted to the endless belt 106. The conveying direction of the film F is changed at the entraining roller 142 so that the film F is conveyed upward. The film end reshaping device 68 is positioned ahead of the film F which is being conveyed upward.

Figure 10:
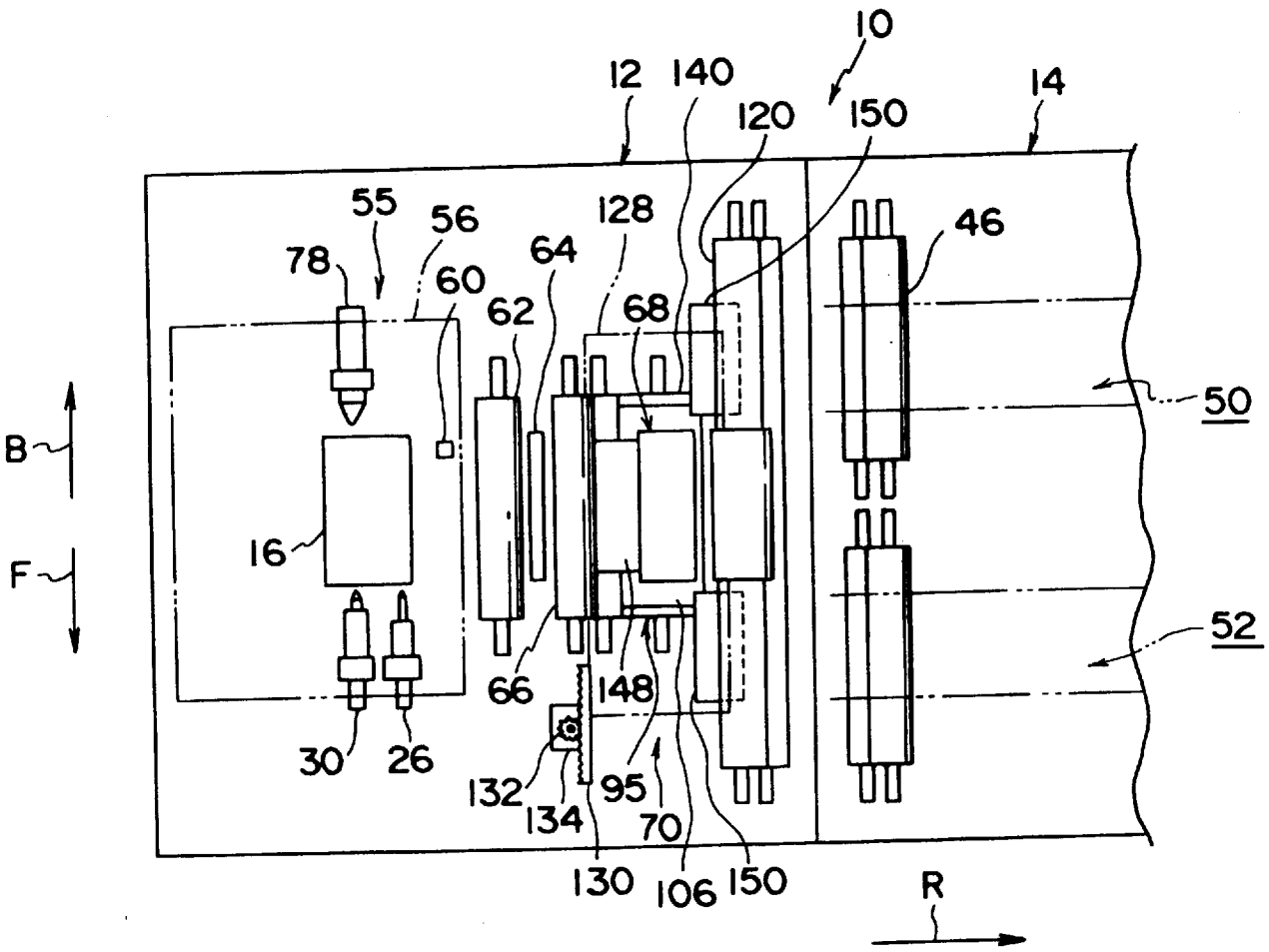
FIG. 10 is a plan view of the film loading/distributing section relating to the second embodiment.

As illustrated in FIG. 10, at the film conveying direction upstream side of the nip rollers 120, a movable guide 150 is provided at each side of the film end reshaping device 68. The movable guides 150 guide, toward the nip rollers 120, the film F which is being conveyed upward by the endless belt 106.

In the present second embodiment, the film F is conveyed while being attracted to the endless belt 106 which rotates counterclockwise in FIG. 9. The movable guides 150 are withdrawn so as to not impede the entry of the leader side end portion FR of the film F into the film end reshaping device 68. The leader side end portion FR of the film F enters into the film end reshaping device 68 and is reshaped thereat.

When the leader side end portion FR of the film F is reshaped at the film end reshaping device 68, the endless belt 106 is rotated a predetermined amount in the opposite direction (i.e., clockwise in FIG. 9). When the reshaped leader side end portion FR is detected by an infrared ray sensor 129 positioned lower than the lower end of the movable guides 150, conveying of the film F is stopped temporarily.

Thereafter, the movable guides 150 are moved to positions for guiding the film F to the nip rollers 120, and with the film F attracted to the endless belt 106, the film distributing device 70 is moved. The endless belt 106 is rotated counterclockwise, and the film F is conveyed to the first conveying/processing line 50 or the second conveying/processing line 52.

In the present second embodiment, only a vicinity of the leader side end portion FR of the film F approaches the cutter 92 of the film end reshaping device 68. Therefore, even if some trouble arises with the film end reshaping device 68, the image portions of the film F are not damaged by the cutter 92. The other effects of the present second embodiment are the same as those of the first embodiment.

Third Embodiment

The film processor 10 relating to a third embodiment of the present invention will be described hereinafter with reference to FIGS. 11 and 12. Structures which are the same as those of the previously-described embodiments are denoted by the same reference numerals, and description thereof will be omitted.

The film processor 10 of the third embodiment is a structure in which a portion of the film processor 10 of the first embodiment has been modified.

Figure 11:
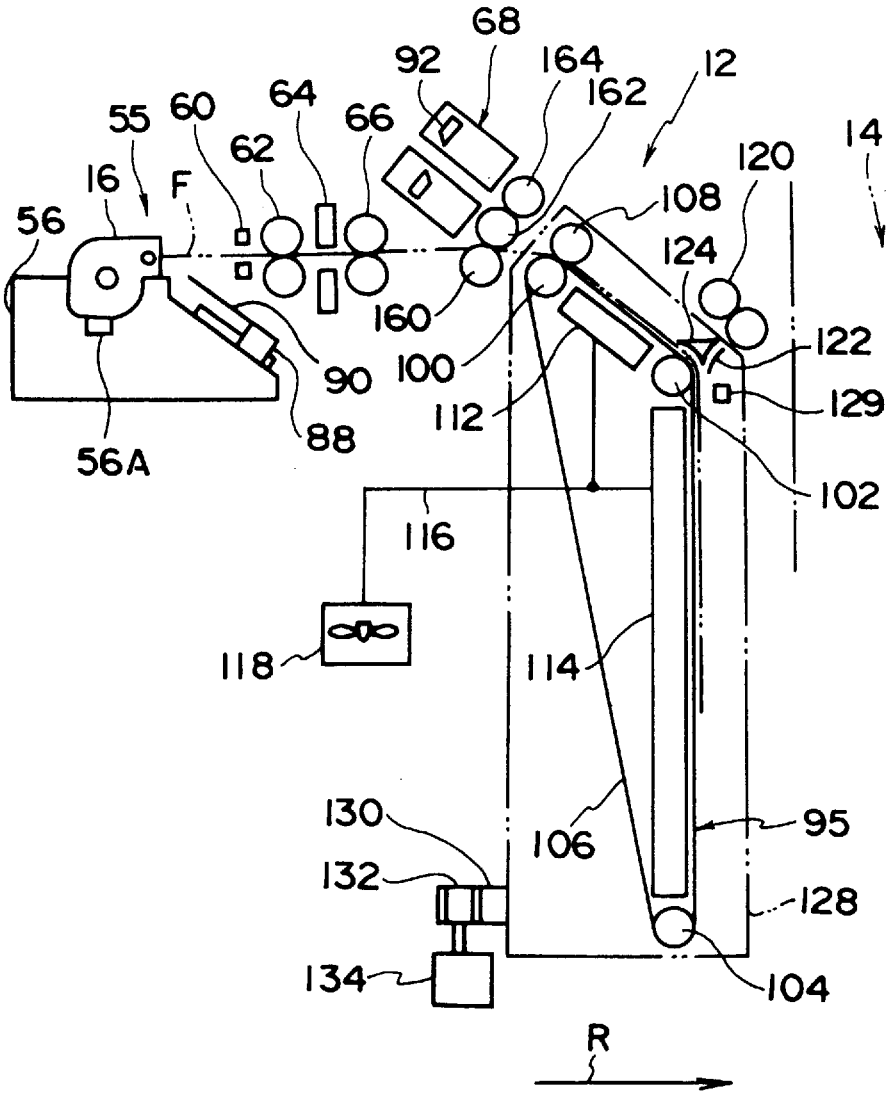
FIG. 11 is a side view of a film loading/distributing section relating to a third embodiment.
Figure 12:
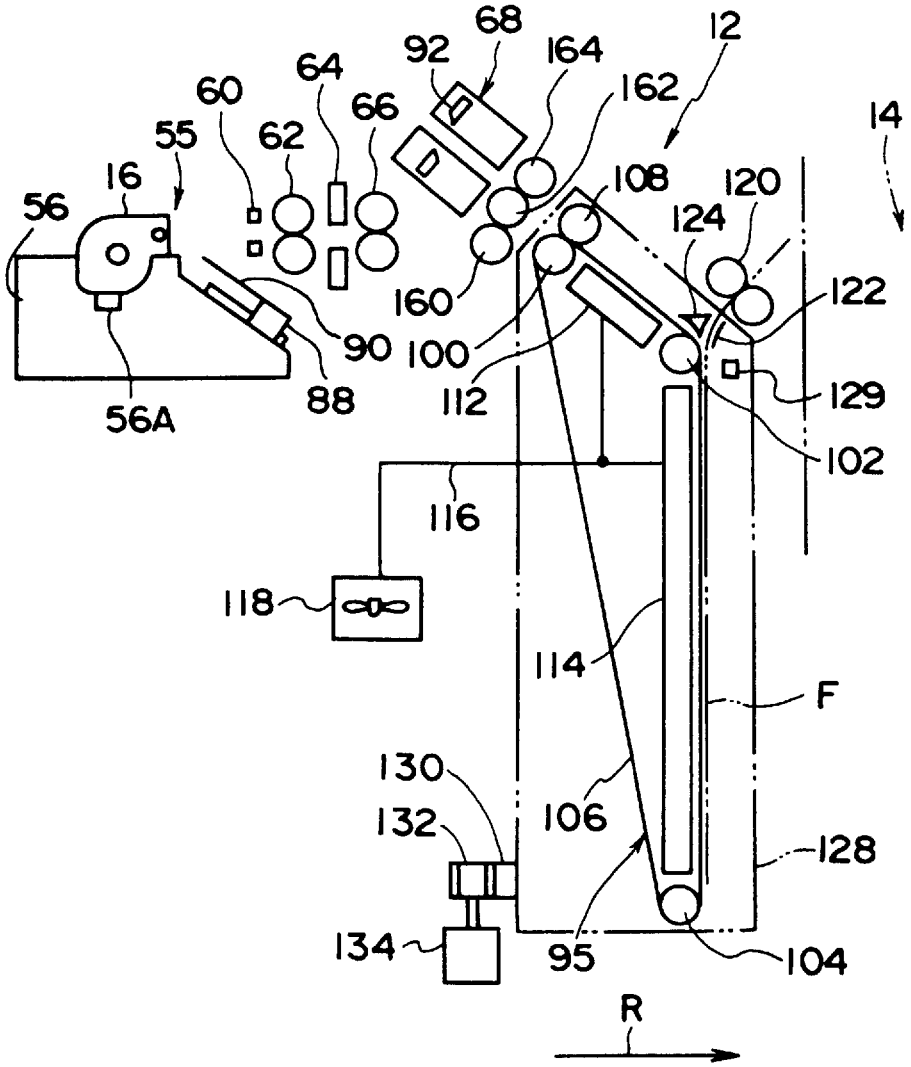
FIG. 12 is a side view of the film loading/distributing section, illustrating a state in which a film is conveyed to a developing processing section.

As illustrated in FIG. 11, the film conveying path between the entraining roller 100 and the entraining roller 102 inclines downwardly toward the entraining roller 102 side.

A roller 160, a roller 162 and a roller 164 are disposed in that order at the film conveying direction downstream side of the nip rollers 66 (the side of the nip rollers 66 in the direction of arrow R). The central roller 162 is a drive roller which can be rotated in forward and reverse directions by an unillustrated motor. The rollers 160, 164 at the sides of the roller 162 are driven rollers which rotate due to contact with the roller 162.

The film F which is delivered out from the nip rollers 66 passes between the roller 162, which is being rotated counterclockwise in FIG. 11, and the roller 160, which is being rotated in the opposite direction. The film F is thereby conveyed to the endless belt 106 which is being rotated clockwise.

When the conveying direction trailing end of the film F (the trailer side end portion FT) passes the roller 108, conveying of the film F is stopped temporarily. Thereafter, the endless belt 106 which attracts the film F is rotated counterclockwise in FIG. 11. In this way, the film F is conveyed from the nip between the endless belt 106 and the roller 108 toward the nip between the roller 162 and the roller 164. Here, if the roller 162 is rotated counterclockwise, the film F enters into the film end reshaping device 68, which is positioned diagonally above, and the conveying direction leading end thereof (the trailer side end portion FT) is reshaped.

After reshaping of the trailer side end portion FT, the roller 162 is rotated clockwise, and the film F is conveyed by the endless belt 106 until the trailer side end portion FT of the film F is detected by the infrared ray sensor 129. Thereafter, as illustrated in FIG. 12, the film F is conveyed, between the fixed guide 122 and the movable guide 124, into the developing processing section 14 with the reshaped end portion thereof (the trailer side end portion FT) being conveyed first.

In the present third embodiment, only a vicinity of the trailer side end portion FT of the film F approaches the cutter 92 of the film end reshaping device 68. Therefore, even if some trouble arises with the film end reshaping device 68, the image portions of the film F are not damaged by the cutter 92. The other effects of the present third embodiment are the same as those of the first embodiment.

As described above, in the photosensitive material processing apparatus of claim 1, photosensitive materials can be distributed by the photosensitive material distributing means. Therefore, even if there are a plurality of photosensitive material conveying/processing lines, it suffices to use a single photosensitive material withdrawing means to withdraw the photosensitive materials from the cartridges. Accordingly, an increase in the number of parts and an increase in cost which are brought about by increasing the number of photosensitive material conveying/processing lines can be suppressed, and an efficient, inexpensive apparatus can be obtained.

In the photosensitive material processing apparatus of the present invention, the photosensitive material withdrawn from the cartridge can be made to standby temporarily before being conveyed to the developing processing section. For example, in cases in which the trailing end of the preceding photosensitive material has not yet completely entered into the developing processing section or the like, the next photosensitive materials can be made to wait in order in the storage section.

In the photosensitive material processing apparatus of the present invention, the photosensitive material withdrawn from the cartridge can be attracted and held. Therefore, there are no local forces acting on the photosensitive material, and the photosensitive material can be held safely.

Further, in the photosensitive material processing apparatus of the present invention, the conveying direction of the photosensitive material withdrawn from the cartridge is changed. The photosensitive material can be conveyed to the developing processing section, with the end of the photosensitive material, which is the trailing end at the time the photosensitive material is withdrawn from the cartridge (i.e., the end at the spool shaft side), being the conveying direction leading end.

Also, in the photosensitive material processing apparatus of the present invention, damage to the photosensitive material withdrawn from the cartridge can be detected before processing at the developing processing section. Therefore, troubles in conveying the film F within the developing processing section, which troubles are caused by damage to the photosensitive material, can be prevented in advance. Examples of such troubles in conveying are the photosensitive material catching on parts in the apparatus or the like, or in the worst case, the photosensitive material being torn into pieces.

In the photosensitive material processing apparatus of the present invention, the conveying direction leading end portion of the photosensitive material withdrawn from the cartridge can be formed in a configuration which allows easy passage through the developing processing section, e.g., a U-shape. In this way, the conveying direction leading end of the photosensitive material can be conveyed smoothly within the developing processing section, and the reliability of conveying can be improved.

What is claimed is:

1. A photosensitive material processing apparatus which processes photosensitive materials which have been photographed, comprising:

photosensitive material withdrawing means for withdrawing a photosensitive material from a cartridge which accommodates the photosensitive material;

a developing processing section having a plurality of photosensitive material conveying/processing lines which are disposed parallel to one another at a conveying direction downstream side of said photosensitive material withdrawing means; and photosensitive material distributing means, provided between said photosensitive material withdrawing means and said developing processing section, for distributing a photosensitive material which has been withdrawn from a cartridge to any one of the plurality of photosensitive material conveying/processing lines.

2. A photosensitive material processing apparatus according to claim 1, wherein said photosensitive material distributing means includes a storing portion for temporarily storing a photosensitive material, which has been conveyed from said photosensitive material withdrawing means, before the photosensitive material is delivered out to said developing processing section.

3. A photosensitive material processing apparatus according to claim 2, wherein the storing portion includes a holding means which is formed by a suction box disposed so as to oppose a reverse surface of at least one linear conveying portion of a conveying belt which is rotatably supported by three entraining rollers, which are disposed at predetermined intervals, and which forms a substantially triangular locus of movement.

4. A photosensitive material processing apparatus according to claim 3, wherein an interior of the suction box is hollow, and a photosensitive material on the conveying belt is attracted by a suction device, which is connected to the suction box, sucking air from the interior of the suction box.

5. A photosensitive material processing apparatus according to claim 2, wherein the storing portion includes a holding means which is formed by a suction box which is disposed between two linear conveying portions of and so as to oppose a reverse surface of a conveying belt which is rotatably supported by two entraining rollers which are separated from each other.

6. A photosensitive material processing apparatus according to claim 5, wherein an interior of the suction box is hollow, and a photosensitive material on the conveying belt is attracted by a suction device, which is connected to the suction box, sucking air from the interior of the suction box.

7. A photosensitive material processing apparatus according to claim 3, wherein said photosensitive material distributing means includes a conveying direction changing means which changes a conveying direction of the photosensitive material.

8. A photosensitive material processing apparatus according to claim 1, further comprising:

photosensitive material inspecting means, provided between said photosensitive material withdrawing means and said photosensitive material distributing means, for inspecting the photosensitive material.

9. A photosensitive material processing apparatus according to claim 1, further comprising:

a reshaping means, provided between said photosensitive material withdrawing means and said developing processing section, for reshaping a conveying direction end portion of the photosensitive material.

10. A photosensitive material processing apparatus according to claim 9, wherein said reshaping means is provided between said photosensitive material withdrawing means and said photosensitive material distributing means.

11. A photosensitive material processing apparatus according to claim 9, wherein said reshaping means is provided between said photosensitive material distributing means and said developing processing section.

12. A photosensitive material processing apparatus according to claim 1, wherein said photosensitive material distributing means is located in a home position when said photosensitive material withdrawing means withdraws photosensitive material from a cartridge.

13. A photosensitive material processing apparatus according to claim 12, wherein said photosensitive material distributing means is configured for receiving the photosensitive material withdrawn by said withdrawing means when said photosensitive material distributing means is in said home position.

14. A photosensitive material processing apparatus according to claim 13, wherein said home position is located between longitudinal axes of two adjacent ones of said parallel photosensitive material conveying/processing lines.

15. A photosensitive material conveying/processing method in which a photosensitive material accommodated in a cartridge is withdrawn, the photosensitive material is conveyed to a developing processing section having a plurality of photosensitive material conveying lines disposed parallel to one another, and the photosensitive material is processed in the developing processing section, said method comprising the steps of:

nipping and conveying, by conveying rollers, a photosensitive material withdrawn from a cartridge;

inspecting, by a photosensitive material inspecting device, the photosensitive material, which is being conveyed, to determine whether the photosensitive material is damaged, and if the photosensitive material is undamaged, continuing conveying the photosensitive material;

detecting, by an infrared ray sensor, a final end vicinity mark provided on the photosensitive material, and separating the photosensitive material from the cartridge;

stopping conveying of the photosensitive material after the photosensitive material has been conveyed a predetermined amount in a conveying direction, and reshaping, by a reshaping means, a final end of the photosensitive material into a predetermined configuration;

conveying the photosensitive material toward a position at which is provided a suction means disposed so as to oppose a reverse surface of at least one linear conveying portion of a conveying belt which is rotatably supported by three entraining rollers and which forms a substantially triangular locus of movement;

continuing conveying the photosensitive material until the final end of the photosensitive material is detected by another infrared ray sensor provided at a vicinity of an entrance to a developing processing section;

attracting and holding the photosensitive material and temporarily stopping driving of the conveying belt, when the final end of the photosensitive material is detected;

rotating the conveying belt reversely, delivering the photosensitive material to a conveying roller of the developing processing section with the final end of the photosensitive material being a conveying direction leading end, and stopping attraction of the photosensitive material; and returning a photosensitive material distributing means to a home position.

16. A method according to claim 15, wherein conveying of the photosensitive material to the developing processing section is carried out by rotating the conveying belt reversely and shifting a conveying guide provided directly before the developing processing section.

17. A photosensitive material conveying/processing method in which a photosensitive material accommodated in a cartridge is withdrawn, the photosensitive material is conveyed to a developing processing section having a plurality of photosensitive material conveying lines disposed parallel to one another, and the photosensitive material is processed in the developing processing section, said method comprising the steps of:

nipping and conveying, by conveying rollers, a photosensitive material withdrawn from a cartridge;

inspecting, by a photosensitive material inspecting device, the photosensitive material, which is being conveyed, to determine whether the photosensitive material is damaged, and if the photosensitive material is undamaged, continuing conveying the photosensitive material;

detecting, by an infrared ray sensor, a final end vicinity mark provided on the photosensitive material, and separating the photosensitive material from the cartridge;

conveying the photosensitive material on a conveying belt rotatably supported by two entraining rollers which are separated from one another in a vertical direction;

conveying a leading end of the photosensitive material to a reshaping means disposed at a conveying direction downstream side of the conveying belt, and reshaping, by the reshaping means, the leading end of the photosensitive material into a predetermined configuration;

rotating the conveying belt reversely and returning the photosensitive material by a predetermined amount toward a suction means disposed between two linear conveying portions of the conveying belt so as to oppose a reverse surface of the conveying belt;

attracting and holding the photosensitive material and temporarily stopping driving of the conveying belt, when the leading end of the photosensitive material is detected by another infrared ray sensor provided at a vicinity of an entrance to a developing processing section;

reversing the rotation of the conveying belt, delivering the photosensitive material to a conveying roller of the developing processing section with the leading end of the photosensitive material being a conveying direction leading end, and stopping attraction of the photosensitive material; and returning a photosensitive material distributing means to a home position.

18. A method according to claim 17, wherein conveying of the photosensitive material to the developing processing section is carried out by rotating the conveying belt and shifting a conveying guide provided directly before the developing processing section.

19. A photosensitive material conveying/processing method in which a photosensitive material accommodated in a cartridge is withdrawn, the photosensitive material is conveyed to a developing processing section having a plurality of photosensitive material conveying lines disposed parallel to one another, and the photosensitive material is processed in the developing processing section, said method comprising the steps of:

nipping and conveying, by conveying rollers, a photosensitive material withdrawn from a cartridge;

inspecting, by a photosensitive material inspecting device, the photosensitive material, which is being conveyed, to determine whether the photosensitive material is damaged, and if the photosensitive material is undamaged, continuing conveying the photosensitive material;

detecting, by an infrared ray sensor, a final end vicinity mark provided on the photosensitive material, and separating the photosensitive material from the cartridge;

conveying the photosensitive material toward a position at which is provided a suction means disposed so as to oppose a reverse surface of at least one linear conveying portion of a conveying belt which is rotatably supported by three entraining rollers and which forms a substantially triangular locus of movement;

stopping conveying of the photosensitive material after the photosensitive material has been conveyed a predetermined amount in a conveying direction;

rotating the conveying belt reversely so as to convey a final end of the photosensitive material to a reshaping means, and reshaping the final end of the photosensitive material, by the reshaping means, into a predetermined configuration;

rotating the conveying belt forward, and continuing conveying of the photosensitive material until the final end of the photosensitive material is detected by another infrared ray sensor provided in a vicinity of an entrance to a developing processing section;

attracting and holding the photosensitive material and temporarily stopping driving of the conveying belt, when the final end of the photosensitive material is detected;

rotating the conveying belt reversely again, delivering the photosensitive material to a conveying roller of the developing processing section with the final end of the photosensitive material being a conveying direction leading end, and stopping attraction of the photosensitive material; and returning a photosensitive material distributing means to a home position.

20. A method according to claim 19, wherein conveying of the photosensitive material to the developing processing section is carried out by rotating the conveying belt reversely and shifting a conveying guide provided directly before the developing processing section.

21. A photosensitive material processing apparatus which processes photosensitive materials which have been photographed, comprising:

a photosensitive material withdrawing section including a spool driver;

a developing processing section having a plurality of photosensitive material conveying/processing lines which are disposed parallel to one another at a conveying direction downstream side of said photosensitive material withdrawing section; and a photosensitive material distributing device, provided between said photosensitive material withdrawing section and said developing processing section, which is configured for movement into and out of alignment with any one of the plurality of photosensitive material conveying/processing lines.

* * * * *